US008646126B2

(12) United States Patent
Carta

(10) Patent No.: US 8,646,126 B2
(45) Date of Patent: Feb. 11, 2014

(54) INFANT BED

(75) Inventor: Paul E. Carta, Condon (AU)

(73) Assignee: Starwove Pty Ltd, Condon (AU)

( * ) Notice: Subject to any disclaimer, the term of this patent is extended or adjusted under 35 U.S.C. 154(b) by 134 days.

(21) Appl. No.: 13/126,507

(22) PCT Filed: Nov. 9, 2009

(86) PCT No.: PCT/AU2009/001450
§ 371 (c)(1),
(2), (4) Date: Apr. 28, 2011

(87) PCT Pub. No.: WO2010/054423
PCT Pub. Date: May 20, 2010

(65) Prior Publication Data

US 2011/0203049 A1 Aug. 25, 2011

(30) Foreign Application Priority Data

Nov. 11, 2008 (AU) ..... 2008905816
Mar. 3, 2009 (AU) ..... 2009900922

(51) Int. Cl.
*A47C 31/00* (2006.01)

(52) U.S. Cl.
USPC ..... 5/93.1; 5/11; 5/611; 5/100

(58) Field of Classification Search
USPC ..... 5/11, 611, 93.1, 100
See application file for complete search history.

(56) References Cited

U.S. PATENT DOCUMENTS

| | | | | |
|---|---|---|---|---|
| 2,448,317 | A | 8/1948 | Lineberry et al. | |
| 2,840,831 | A | 7/1958 | Kedrowski | |
| 5,802,634 | A * | 9/1998 | Onishi et al. | 5/93.2 |
| 5,884,348 | A * | 3/1999 | Onishi et al. | 5/93.2 |
| 6,339,855 | B1 * | 1/2002 | Socha et al. | 5/93.1 |
| 6,618,877 | B2 | 9/2003 | Stephen | |
| 6,684,420 | B2 | 2/2004 | Koenig et al. | |
| 6,938,286 | B1 | 9/2005 | Smith | |
| 7,428,760 | B2 * | 9/2008 | McCrimmon | 5/611 |
| 7,437,786 | B2 * | 10/2008 | Bellingroth | 5/611 |
| 7,827,631 | B2 * | 11/2010 | Holman | 5/93.1 |
| 2003/0135923 | A1 * | 7/2003 | Godin et al. | 5/100 |
| 2004/0244109 | A1 * | 12/2004 | Koenig et al. | 5/93.1 |
| 2005/0223491 | A1 * | 10/2005 | McCrimmon | 5/11 |
| 2006/0000017 | A1 * | 1/2006 | Hernandez | 5/93.1 |
| 2006/0075565 | A1 * | 4/2006 | Agre et al. | 5/660 |
| 2006/0265805 | A1 * | 11/2006 | Bellingroth | 5/11 |
| 2007/0180620 | A1 | 8/2007 | Bellingroth | |
| 2009/0070929 | A1 | 3/2009 | Holman | |

FOREIGN PATENT DOCUMENTS

| | | | |
|---|---|---|---|
| GB | 2 422 303 | A | 7/2006 |
| WO | 2008/036668 | A1 | 3/2008 |

* cited by examiner

*Primary Examiner* — William Kelleher
(74) *Attorney, Agent, or Firm* — Ladas & Parry LLP

(57) ABSTRACT

One aspect of the present invention relates to an infant bed. The infant bed includes a chassis. A carriage moves relative to the chassis and includes a mattress support upon which a mattress can rest. A motorized control assembly enables a user to controllably move the carriage relative to the chassis. In one embodiment, the carriage includes a pair of end panels and a rear panel extending vertically upward from the mattress support. A front panel may be slidably mounted to the chassis to thereby contain the infant in the infant bed.

16 Claims, 4 Drawing Sheets

INFANT BED

TECHNICAL FIELD

The present invention relates to infant beds.

BACKGROUND

The reference to any prior art in this specification is not, and should not be taken as an acknowledgement or any form of suggestion that the prior art forms part of the common general knowledge.

An infant bed (commonly referred to as a cot, crib, cradle or stock) is a small bed specifically for infants, generally up to 3 years old. Infant beds are typically used as beds for babies after it is no longer safe to leave them in bassinets, which tend to be less stable.

Infant beds are designed to restrict the baby to the bed. Side panels form an enclosure that is too high for a baby to climb and provide no footholds. Placing a baby into an infant bed can put strain on a caretaker's back. To reduce the strain on those operating an infant bed, infant beds can include a drop-side (or front panel) which can be lowered to ease the process of putting the child into the bed, but can be raised again to restore the integrity of the enclosure.

U.S. Pat. No. 6,938,286 and U.S. Pat. No. 6,618,877 disclose elevated infant beds that permit a wheelchair bound caretaker to access infants in bed as their wheelchair passes beneath the mattress support. However, in practice, wheelchairs (and caretakers) have varying dimensions and the seated position of the wheelchair bound caretakers may vary and not be conducive to easy access to the baby in the bed.

Embodiments of the present invention provide an infant bed which facilitates access to a baby in the bed by a wheelchair bound caretaker, independent of the type of wheelchair used and the particular caretaker.

SUMMARY OF THE INVENTION

According to one aspect of the present invention, there is provided an infant bed including:

- a chassis;
- a carriage for moving relative to the chassis and including a mattress support upon which a mattress can rest, the carriage further including a pair of end infant barriers and a rear infant barrier fastened relative to the mattress support;
- a motorized control assembly for enabling a user to control the height of the carriage; and
- a front infant barrier for mounting so that the carriage can move relative to the front infant barrier.

The motorized control assembly enables a caretaker to readily adjust the height of the mattress support without toil. The height of the mattress support can be adjusted to suit any caretaker seated in any wheelchair so that the caretaker has easy access to the baby in the bed.

The carriage may linearly move relative to the chassis. The infant barriers may include panels extending vertically upward from the mattress support. Each panel and the mattress support may be slatted.

The chassis may include a base assembly and a quartet of upright posts extending from the base assembly. The motorized control assembly may include a pair of linear actuators mounted to opposite sides of the base assembly and for moving the carriage relative to the chassis to control the height of the mattress support. Each linear actuator may have a motor, and an extensible and retractable pole driven by the motor.

The motor may be an electric motor. The motorized control assembly may include a wireless remote control for operating the linear actuators.

The carriage may include a quartet of receptacles for receiving respective posts.

The front infant barrier may be a front panel slidably mounted relative to the chassis or the carriage. The infant bed may further include a moving mechanism for lifting and lowering the front panel. The moving mechanism may include a lever arrangement which counterbalances the front panel with the carriage so that the front panel is lowered when the carriage is lifted, and visa versa. The lever arrangement may include a pair of levers pivotally mounted to the chassis. Each lever may include an elongate lever arm which is pivotally mounted about its centre to the chassis, and engagement rollers rotationally mounted to respective ends of the arm.

Each panel and the mattress support may be slatted. Preferably, the infant bed is a baby's cot or crib.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
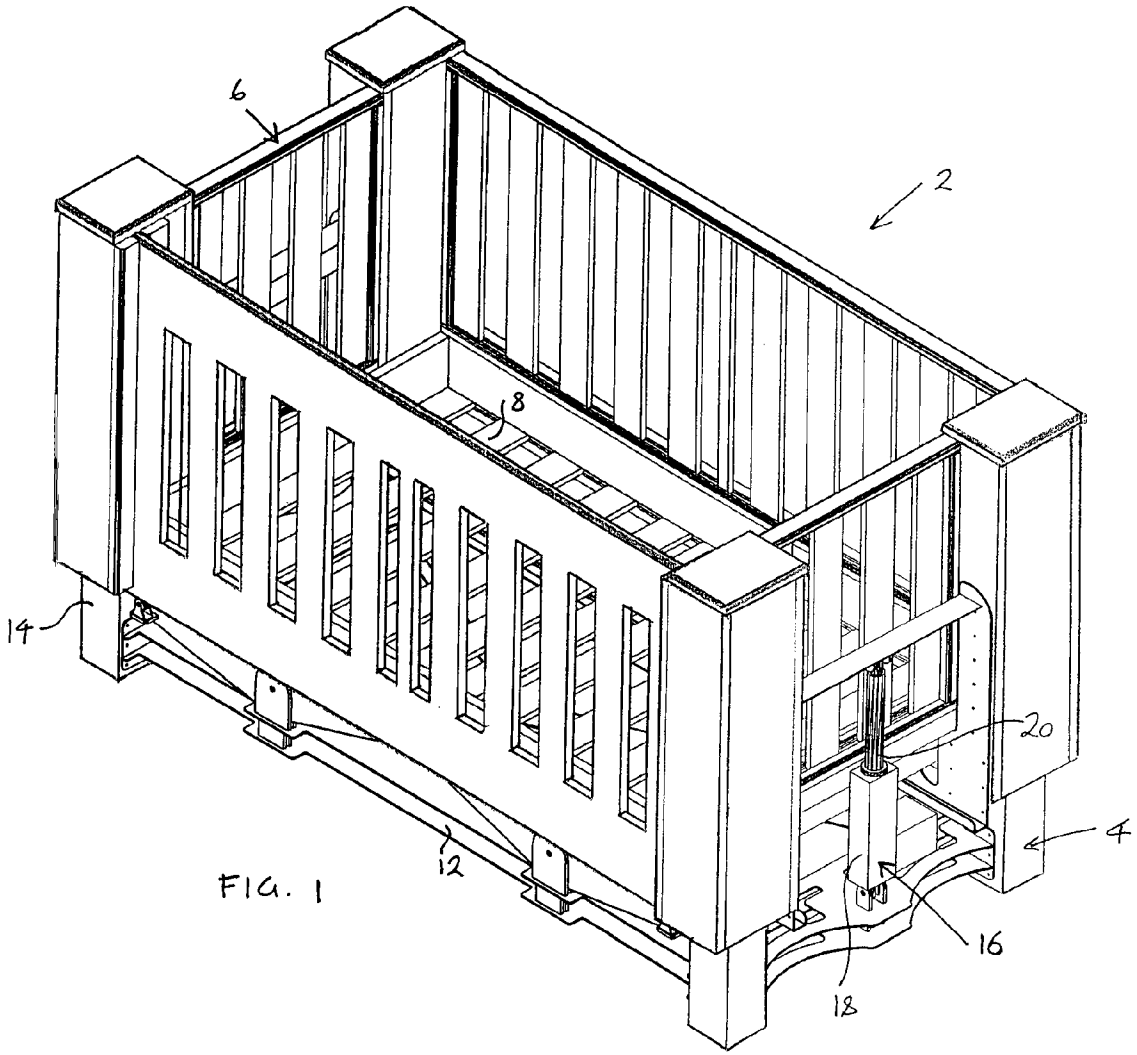
FIG. 1 is an upper perspective view of an infant bed according to an embodiment of the present invention.
Figure 2:
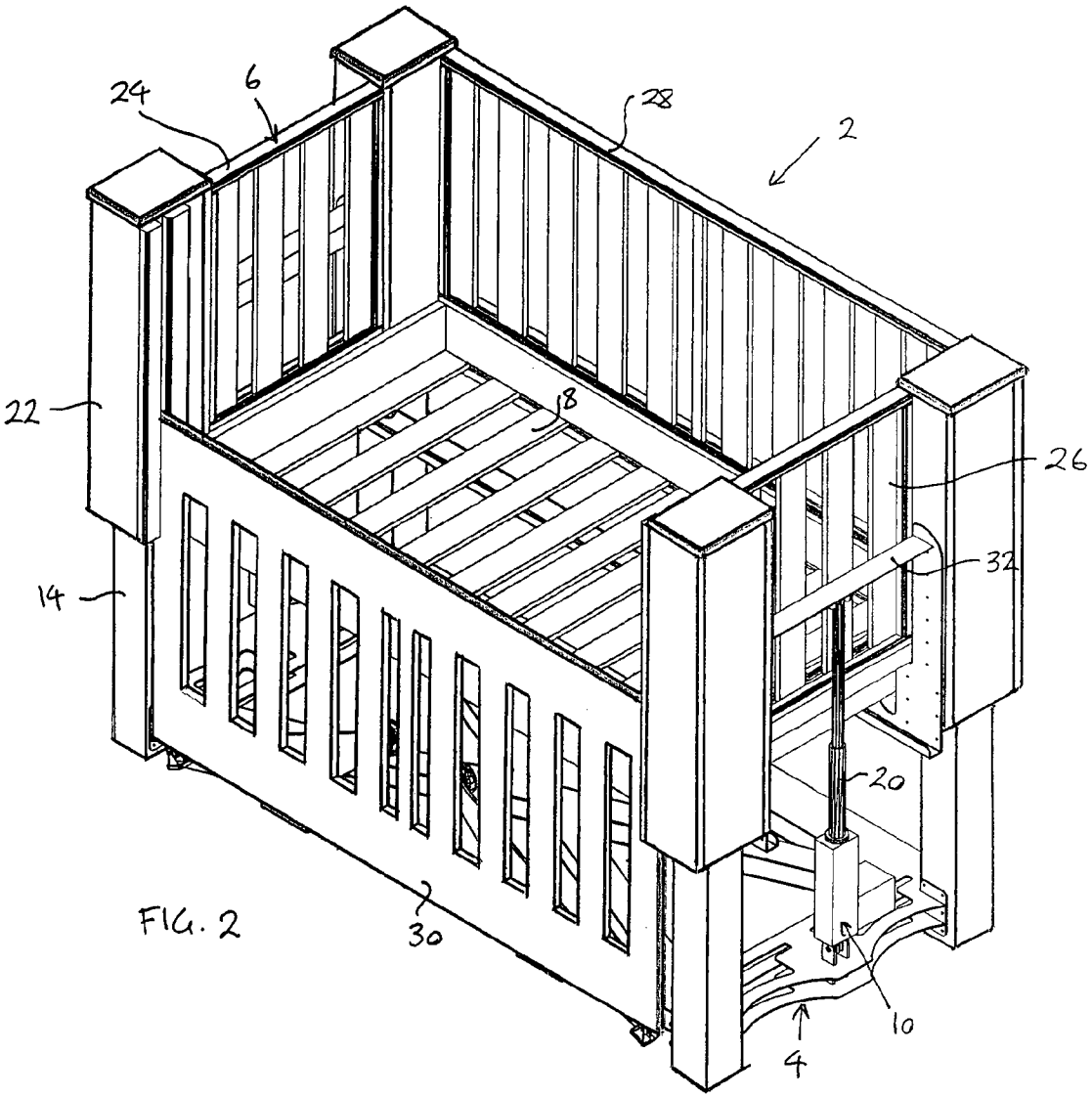
FIG. 2 is an upper perspective view of the infant bed of FIG. 1, with a mattress support of the bed being elevated so that a wheelchair bound caretaker has easy access to a baby in the bed.

According to an embodiment of the present invention, there is provided an infant bed 2 as shown in FIG. 1. The bed 2 includes a stationary chassis 4 which rests upon the floor. Turning to FIG. 2, a carriage 6 linearly moves relative to the chassis 4 and includes a mattress support 8 upon which a mattress (not shown) can rest. A motorized control assembly 10 enables a wheelchair bound caretaker to controllably move the carriage 6 relative to the chassis 4. The motorized control assembly 10 enables the caretaker to readily adjust the height of the mattress support 8 without toil. The height of the mattress support 8 can be adjusted to suit any caretaker seated in any wheelchair so that the caretaker has easy access to the baby resting on the mattress on the bed 2. A detailed description of the bed 2 is provided below.

Turning to FIG. 1, the chassis 4 includes a base assembly 12 and a quartet of upright posts 14 extending from the base assembly 12. The motorized control assembly 10 includes a pair of linear actuators 16 mounted to opposite sides of the base assembly 12. The actuators 16 rectilinearly move the carriage 6 relative to the chassis 4 to control the height of the mattress support 8. Each linear actuator 16 has an electric motor 18, and an extensible and retractable telescopic pole 20 driven by the motor 18. The motorized control assembly 10 includes a wireless remote control unit (not shown) for operating the linear actuators 16 in unison.

Returning to FIG. 2, the carriage 6 includes a quartet of receptacles 22 for receiving respective posts 14. The carriage 6 includes a pair of slatted end panels 24, 26 and a slatted rear panel 28. Each panel 24, 26, 28 extends vertically upward from the mattress support 8 and is mounted between adjacent receptacles 22. The infant bed 2 also includes a slatted front panel 30 which is slidably mounted to the front posts 14 of the chassis 4. Together, the slatted panels 24, 26, 28, 30 form an enclosure to contain a baby. The carriage 6 also includes a pair of end shelves 32 mounted between adjacent receptacles 22 and against which the telescopic poles 20 of the motor assembly 10 can push to lift the carriage 6.

Figure 3:
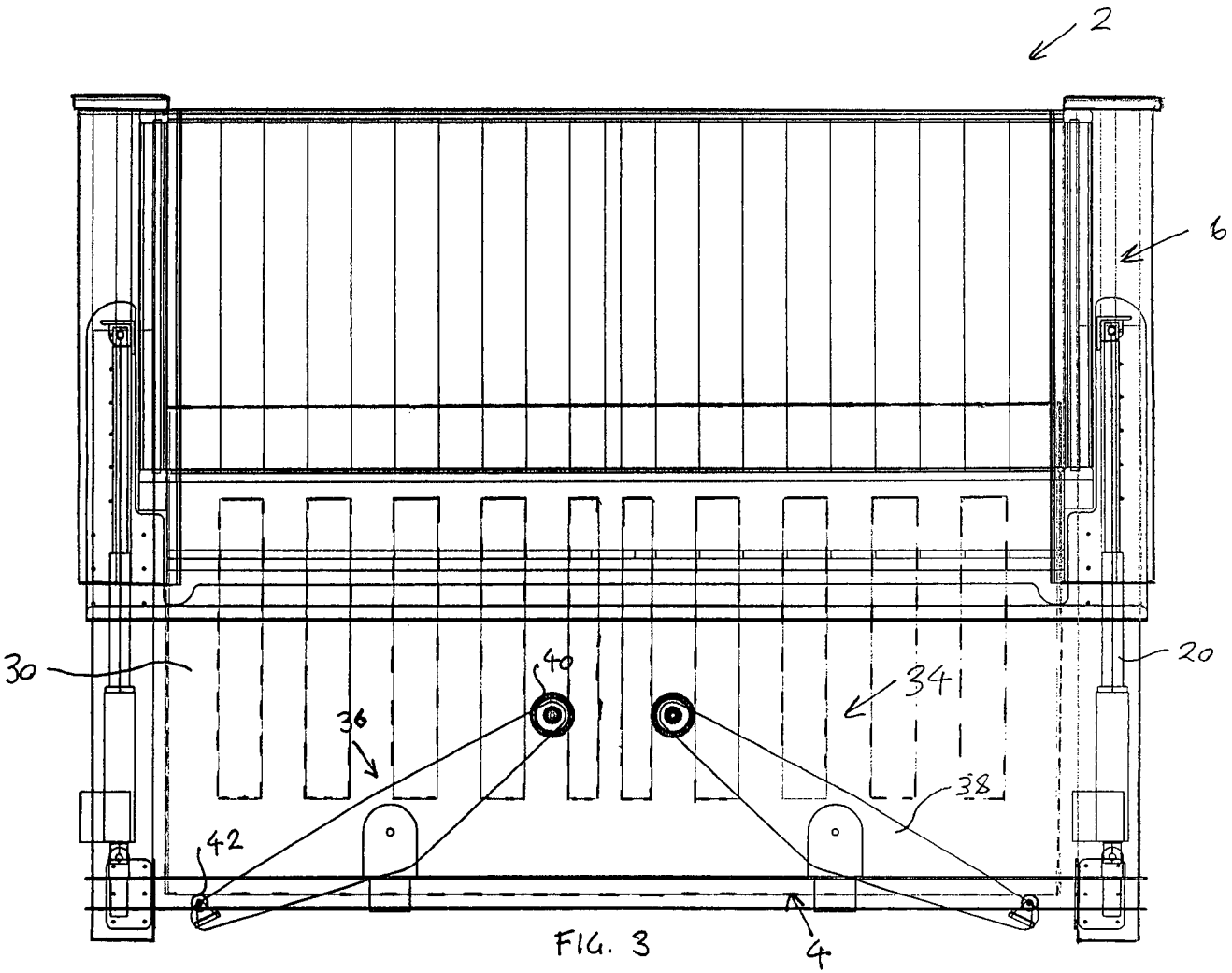
FIG. 3 is a front perspective view of the infant bed of FIG. 2.

Turning to FIG. 3, the infant bed 2 further includes a moving mechanism 34 for lifting and lowering the front panel 30. The moving mechanism 34 includes a lever arrangement which counterbalances the front panel 30 with the carriage 6 so that the front panel 30 is lowered when the carriage 6 is lifted, and visa versa. The lever arrangement includes a pair of levers 36 pivotally mounted to the chassis 4. Each lever 36 include an elongate lever arm 38 which is pivotally mounted about its centre to the chassis 4, and a pair of engagement rollers 40, 42 rotationally mounted to respective ends of the arm 38.

Figure 4:
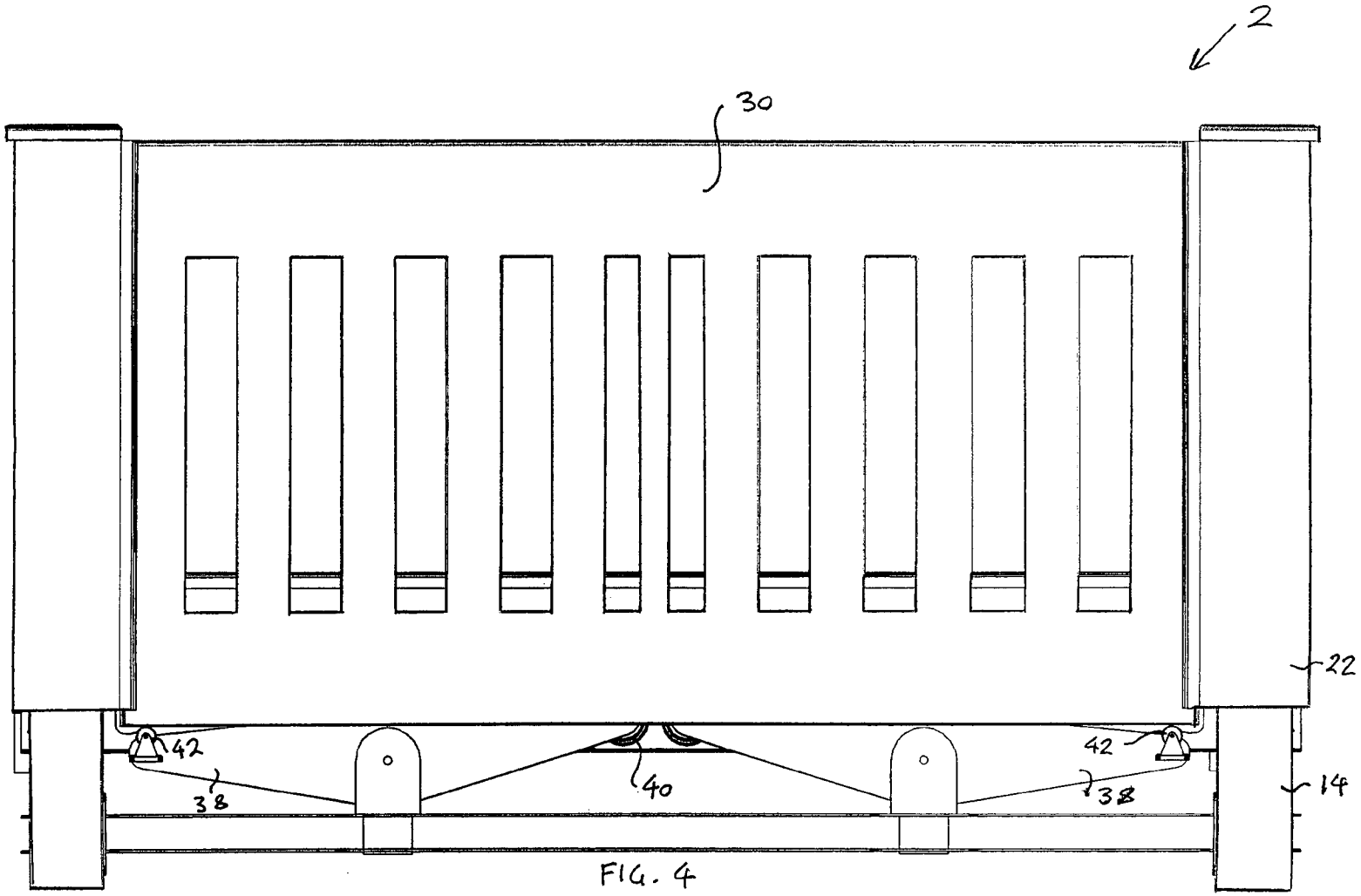
FIG. 4 is a front perspective view of the infant bed of FIG. 1.

The front panel engagement rollers 42 are always engaged with the underside of the front panel 30 whereas the carriage engagement rollers 40 can engage with the underside of the carriage 6. As the carriage 6 is linearly lowered, it engages with the carriage engagement rollers 40 which cause the lever arms 38 to pivot. In turn, the front panel engagement rollers 42 move upwardly and raise the front panel 30 as shown in FIG. 4. Alternatively, as the carriage 6 is linearly raised, the lever arms 38 pivot in the opposite direction and lower the front panel 30.

The use of the infant bed 2 will now be briefly described.

Initially, a baby may be in the bed 2 and resting upon the mattress when the carriage 6 is fully lowered as shown in FIG. 1.

The wheelchair bound caretaker may position the wheelchair adjacent to the front panel 30. Next, the wheelchair bound caretaker can incrementally raise the carriage 6 to a desired height with the wireless remote control unit that controls the linear actuators 16. In turn, the front panel 30 is lowered so that the carriage 6 need not be raised excessively high. The caretaker can adjust the carriage 6 to a suitable height so that the caretaker has easy access to the baby resting on the mattress in the bed 2. The caretaker can then pick up the baby from the bed 2.

Once the caretaker has finished attending to the baby, the caretaker can then place the baby back into the bed 2. Next, the caretaker can incrementally lower the carriage 6, using the wireless remote control unit to control the linear actuators 16. In turn, the front panel 30 is elevated by the lever arrangement. The caretaker can lower the carriage 6 to a suitable height so that the front panel 30 and carriage 6 form a secure enclosure to contain the child.

A person skilled in the art will appreciate that many embodiments and variations can be made without departing from the ambit of the present invention.

In one embodiment, the infant bed 2 (which is in the form of a baby's cot or crib) can have its front and rear panels 28, 30 removed to form a junior bed. The end panels 24, 26 may also be removed.

In the preferred embodiment, the moving mechanism 34 included a lever arrangement to lift and lower the front panel 30 only. In an alternative embodiment, the rear panel 28 may also be slidably mounted to the chassis and the moving mechanism 34 may include another lever arrangement to similarly lift and lower the rear panel 28.

The bed of the preferred embodiment was described with reference to a infant's bed 2. In an alternative embodiment, the bed may be sized to sleep an adult and can be used in hospitals and aged care facilities.

The motorized control assembly 10 is typically powered by mains-power (e.g. 240V). In one embodiment, the motorized control assembly 10 further includes an auxiliary power supply for supplying power to the electric motors 18 in the event of mains-power failure. The auxiliary power supply includes a battery and a charging circuit for charging the battery when mains-power is connected.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

The invention claimed is:

1. An infant bed including:

a chassis including a base frame and four upright posts extending from the base frame;

a front infant barrier mounted to the chassis;

a carriage independently moveable relative to the chassis using a motorized control assembly, the carriage including a mattress support upon which a mattress can rest, a pair of end infant barriers and a rear infant barrier fastened relative to the mattress support;

the motorized control assembly for enabling a user to control the height of the carriage; and such that the carriage can move relative to the front infant barrier.

2. An infant bed as claimed in claim 1, wherein the carriage can linearly move relative to the chassis.

3. An infant bed as claimed in claim 1, wherein the infant barriers include panels extending vertically upward from the mattress support, each panel and the mattress support being slatted.

4. An infant bed as claimed in claim 1, wherein the motorized control assembly includes a pair of linear actuators mounted to opposite sides of the base frame and for moving the carriage relative to the chassis to control the height of the mattress support.

5. An infant bed as claimed in claim 4, wherein each linear actuator has an electric motor, and an extensible and retractable pole driven by the motor.

6. An infant bed as claimed in claim 5, wherein the motorized control assembly further includes an auxiliary power supply for supplying power to the electric motors in the event of mains-power failure.

7. An infant bed as claimed in claim 6, wherein the auxiliary power supply includes a battery and a charging circuit for charging the battery.

8. An infant bed as claimed in claim 4, wherein the motorized control assembly may include a wireless remote control for operating the linear actuators.

9. An infant bed as claimed in claim 1, wherein the carriage includes a quartet of receptacles for covering respective posts.

10. An infant bed as claimed in claim 1, wherein the front infant barrier includes a front panel slidably mounted relative to the chassis or the carriage.

11. An infant bed as claimed in claim 10, further including a moving mechanism for lifting and lowering the front panel.

12. An infant bed as claimed in claim 11, wherein the moving mechanism includes a lever arrangement which counterbalances the front panel with the carriage so that the front panel is lowered when the carriage is lifted, and visa versa.

13. An infant bed as claimed in claim 12, wherein the lever arrangement includes a pair of levers pivotally mounted to the chassis.

14. An infant bed as claimed in claim 13, wherein each lever includes an elongate lever arm which is pivotally mounted about its centre to the chassis, and engagement rollers rotationally mounted to respective ends of the arm.

15. An infant bed as claimed in claim 1 and in the form of a baby's cot or crib.

16. An infant bed as claimed in claim 1, wherein the front infant barrier is mounted to the base frame.

* * * * *